US006366036B1

(12) United States Patent
Kordts et al.

(10) Patent No.: US 6,366,036 B1
(45) Date of Patent: Apr. 2, 2002

(54) ARRANGEMENT FOR COUPLING OUT AN OUTPUT CURRENT FROM A LOAD CURRENT AND FOR GAINING A CONTROL VALUE TO CONTROL THE LOAD CURRENT

(75) Inventors: Jürgen Kordts, Buxtehude; Ralf Beier; Axel Näthe, both of Hamburg, all of (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/663,591

(22) Filed: Sep. 18, 2000

(30) Foreign Application Priority Data

Sep. 16, 1999 (DE) ..... 199 44 397

(51) Int. Cl.[7] ..... H01J 29/70

(52) U.S. Cl. ..... 315/399; 315/395; 315/387

(58) Field of Search ..... 315/399, 396, 315/397, 401, 395, 387; 348/529, 530, 500, 746

(56) References Cited

U.S. PATENT DOCUMENTS 5,359,267 A * 10/1994 Wilber ..... 315/403
5,648,703 A * 7/1997 George ..... 315/371
5,889,421 A * 3/1999 Cirot et al. ..... 327/141
5,910,748 A * 6/1999 Reffay et al. ..... 327/432
5,969,487 A * 10/1999 Peetoom ..... 315/387

FOREIGN PATENT DOCUMENTS

JP 100107558 * 4/1998

OTHER PUBLICATIONS

Philips Semiconductors Product Specification—TDA 4866.

* cited by examiner

*Primary Examiner*—Don Wong
*Assistant Examiner*—Ephrem Alemu
(74) *Attorney, Agent, or Firm*—Steven R. Biren

(57) ABSTRACT

In an arrangement for coupling out an output current from a load current by a load (2), particularly a deflection coil of a cathode ray tube by means of an output resistor (4), which arrangement comprises an output current mirror (9, 10, 11), in which a control value in the form of the difference between two voltages dropping across two resistors (35, 36) for controlling the load current is generated and in which a reference current bank (12) is provided with a current mirror circuit whose input receives a constant current for generating constant currents, a minimal temperature dependence is obtained in that the output current is coupled to the emitter of at least a first output transistor (10) and at least a second output transistor (11) of the output current mirror, in that the reference current bank (12) supplies a first reference current which, together with the output current, is coupled to the emitter of the first output transistor (10) and the second output transistor (11) of the output current mirror, in that the current through the collector of the first output transistor (10) of the output current mirror is coupled to the input of a first current mirror (23), in that the output current of the first current mirror (23) is coupled to the collector of at least one input transistor (9) of the output current mirror, in that a second current mirror (27) is provided to whose input the current through the collector of the second output transistor (11) of the output current mirror is coupled and whose output current is coupled to a first resistor (35), in that a third current mirror (28) is provided to whose input a second reference current from the reference current bank (12) is coupled and whose output current is coupled to a second resistor (36), in that the input transistor (9) of the output current mirror has the same emitter area as that of the first output transistor (10), and in that the difference between the voltages dropping across the first resistor (35) and the second resistor (36) represents the control value.

8 Claims, 1 Drawing Sheet

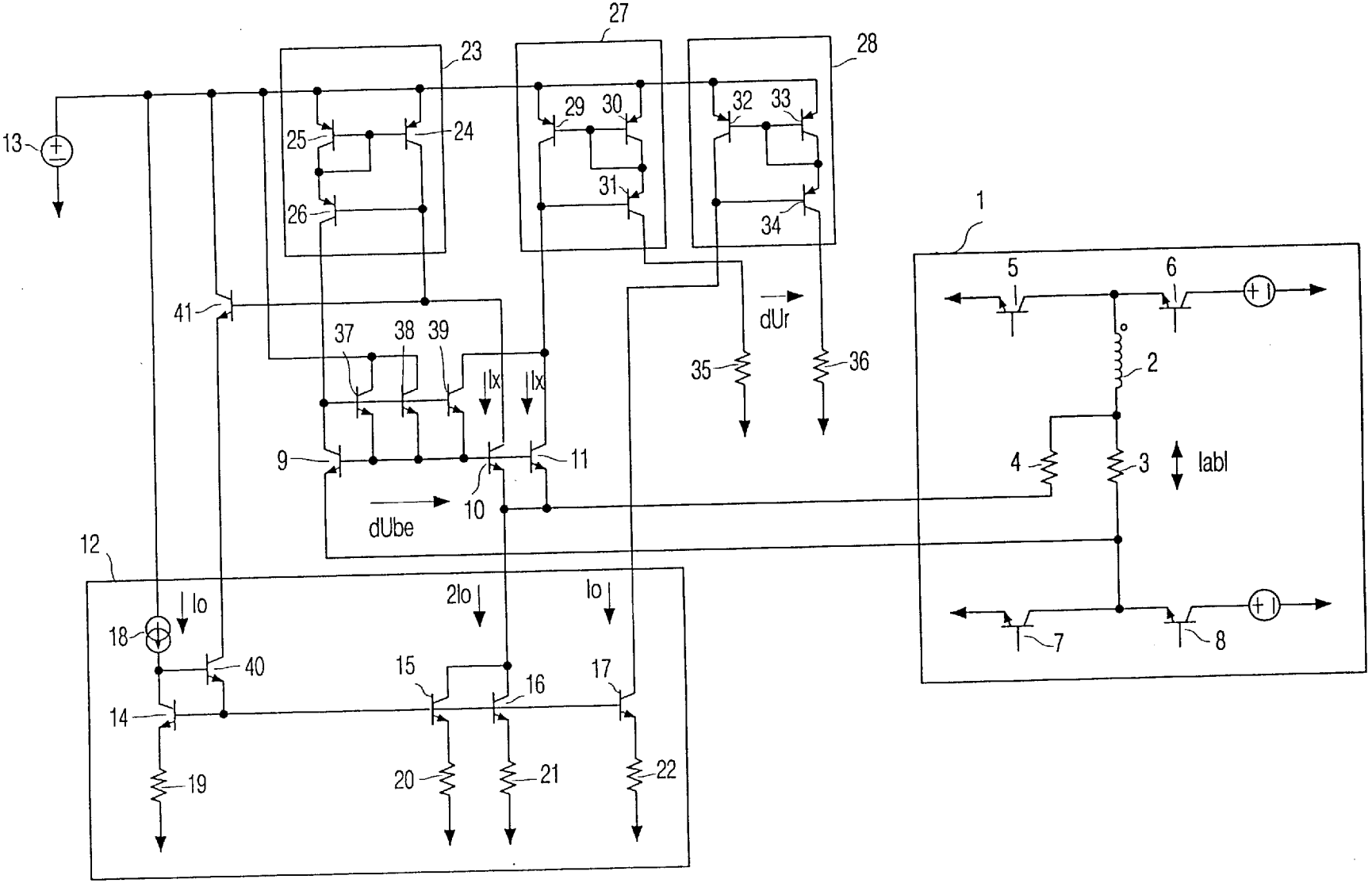
1
2
3
4
5
6
7
8
|ab|
28
27
23
24
25
26
29
30
31
32
33
34
35
36
dUr
11
10
9
39
38
37
dUbe
41
13
12
17
16
15
22
21
20
40
18
14
19
|Io|
2|Io|
|Io|

ARRANGEMENT FOR COUPLING OUT AN OUTPUT CURRENT FROM A LOAD CURRENT AND FOR GAINING A CONTROL VALUE TO CONTROL THE LOAD CURRENT

BACKGROUND OF THE INVENTION

The invention relates to an arrangement for coupling out an output current from a load current by a load, particularly a deflection coil of a cathode ray tube by means of an output resistor, which arrangement comprises an output current mirror, in which a control value in the form of the difference between two voltages dropping across two resistors for controlling the load current is generated and in which a reference current bank is provided with a current mirror circuit whose input receives a constant current for generating constant currents.

Such an arrangement is known from IC TDA 4866 marketed by Philips Semiconductors. This IC is used to gain a control value from the current flowing through a deflection coil of a display tube so as to control this current. To this end, an output current is gained via an output resistor. The output current is coupled to two transistors which are cross-coupled to two output transistors of an output current mirror. The cross-coupling of these transistors serves to reduce the temperature dependence of the circuit. Actually, this is not effected completely so that a temperature dependence of the circuit still remains. Furthermore, the cross-coupled output stage has the drawback that it tends to oscillate.

SUMMARY OF THE INVENTION

It is an object of the invention to provide an arrangement of the type described in the opening paragraph which has substantially no temperature dependence and no oscillation tendencies.

According to the invention, this object is achieved in that the output current is coupled to the emitter of at least a first output transistor and at least a second output transistor of the output current mirror, in that the reference current bank supplies a first reference current which, together with the output current, is coupled to the emitter of the first output transistor and the second output transistor of the output current mirror, in that the current through the collector of the first output transistor of the output current mirror is coupled to the input of a first current mirror, in that the output current of the first current mirror is coupled to the collector of an input transistor of the output current mirror, in that a second current mirror is provided to whose input the current through the collector of the second output transistor of the output current mirror is coupled and whose output current is coupled to a first resistor, in that a third current mirror is provided to whose input a second reference current from the reference current bank is coupled and whose output current is coupled to a second resistor, in that the input transistor of the output current mirror has the same emitter area as that of the first output transistor, and in that the difference between the voltages dropping across the first resistor and the second resistor represents the control value.

In the arrangement according to the invention, a load current is coupled out by means of an output resistor by a load, for example, the deflection coil of a television display tube, a monitor tube or the winding of a motor. This current which is coupled out is relatively small as compared with the current flowing through the load. It is an object of the arrangement to gain a control value in dependence upon this output current which in its turn is dependent on the load current through the load, which control value is suitable for controlling the load current. It is essential that no additional errors due to, for example, temperature dependencies occur when gaining this control value.

In the arrangement according to the invention, this is achieved by means of the following measures. The output current is not coupled only to an output transistor of the output current mirror but to all output transistors of the output current mirror. The output current mirror has at least a first and at least a second output transistor. In other words, the output current mirror has two categories of output transistors, at least one of which is each time available.

Furthermore, a reference current bank is provided whose input receives a constant current and which comprises a current mirror circuit. The reference current bank supplies a first reference current which, together with the output current, is coupled to the emitter of the first and the second output transistor of the output current mirror. This is an essential difference with the state-of-the-art circuit.

To ensure that the voltage through the base-emitter paths of the input transistor of the output current mirror and the output transistors of the output current mirror is minimal, or tends towards zero, the current through the collector of the first output transistor of the output current mirror is coupled to the input of a first current mirror. The output current of this first current mirror is coupled again to the collector of the input transistor of the output current mirror. It is thereby achieved that a current of the same value as in the output transistors flows in the input transistor of the output current mirror. This in turn has the result that the base-emitter voltage tends towards zero. It is thereby achieved that there is no noticeable temperature dependence of the circuit. A condition for this is that the input transistor(s) of the output current mirror has (have) the same emitter areas as those of the first input transistor(s).

Furthermore, a second current mirror is provided to whose input the current through the second output transistor(s) of the output current mirror is coupled. The output current of this second current mirror is coupled to a first resistor.

The reference current bank also supplies a second reference current which is coupled to a third current mirror whose output current is coupled to a second resistor. In this circuitry, the difference of the voltage dropping across the first and the second resistor supplies the control value. The value of the first reference current in relation to the second reference current is dependent on the number of output transistors of the output current mirror. When the output current mirror has n output transistors with equal emitter areas, the first reference current is n times as large as the second reference current.

As a result, the circuit arrangement has a clearly reduced temperature drift because the current gain of the transistors does not influence the behavior of the circuit due to the base-emitter voltage tending towards zero in the output current mirror. Furthermore, the circuit arrangement has a stable behavior in a control loop, also in the MHz range.

As already explained hereinbefore, one or more output transistors of the first and the second category may be arranged in the output current mirror. Moreover, these output transistors may fundamentally have emitters with different areas so that also different currents flow. However, the simplest solution, which is also efficient to an unlimited extent, is the embodiment in accordance with the invention as defined in claim 2. For this solution, only two transistors with equal emitter areas are required, with currents of the same value then flowing through them.

In the normal case, all output transistors of the output current mirror will have equal transistor areas. The reference currents as defined in claim 3 are then to be dimensioned.

To compensate the base currents of the transistors of the output current mirror, the measures as defined in claim 4 are used in a further embodiment of the invention. It is achieved by means of these measures that the base currents are completely derived. This is achieved in that n+k compensation transistors for deriving the base currents are used in the case where the output current mirror has n output transistors and k input transistors. When m is the number of the second output transistors of the output current mirror, n+k−m base currents are drained to a power supply potential. To this end, n+k−m compensation transistors are provided. Furthermore, m base currents are drained by m compensation transistors, which currents are coupled to the input current of the second current mirror and are thus superimposed on the current supplied by the second output transistors of the output current mirror to this second current mirror. It is thereby achieved that the base current errors of the transistors of the second category of the output current mirror in the input current of the second current mirror are compensated.

A further embodiment of the invention as defined in claim 5 has the object and advantage that the circuit configuration of the transistors as defined in claim 5 ensures a safe start-up of the circuit arrangement when switching on the power supply. The additional current coupled into the first current mirror by this circuit arrangement serves for supplying a current from the output, ensuring flawless operation of the circuit arrangement when the power supply is switched on. However, the current is very small in proportion to the useful currents flowing in the output current mirror and in the first current mirror.

These and other aspects of the invention are apparent from and will be elucidated with reference to the embodiments described hereinafter.

BRIEF DESCRIPTION OF THE DRAWINGS

In the drawing:

The sole FIGURE is a cross-section 1 of a load, whose circuit elements are shown only partially. The load is a television apparatus or a computer monitor comprising a cathode ray tube. The cathode ray tube comprises vertical and horizontal deflection coils, a vertical deflection coil 2 of which is shown in the FIGURE. A current Iabl through this vertical deflection coil controls the vertical deflection within this tube. This load current is to be controlled.

DESCRIPTION OF THE PREFERRED EMBODIMENTS

To control this load current, a control value is to be gained by means of the arrangement according to the invention, on which strict requirements as regards offset, temperature dependence and linearity are to be imposed. Particularly, there should be a minimal temperature drift.

A resistor 3 is arranged in series with the vertical deflection coil 2, which resistor is connected parallel to the output resistor 4 which is dimensioned in the same way as the resistor 3. Due to the equal voltages dropping at the resistors 3 and 4, a current, which is proportional to the current through the vertical deflection coil 2, flows through the resistor 4.

To control the current through the vertical deflection coil 2, four transistors 5, 6, 7 and 8 arranged in a bridge configuration are provided, which are controllable in dependence upon the control value to be gained by means of the circuit arrangement according to the invention. This control is not further shown in the FIGURE.

The arrangement shown in the FIGURE comprises an output current mirror with an input transistor 9, a first output transistor 10 and a second output transistor 11. The output current flowing through the output resistor 4 is coupled to the emitters of the two output transistors 10 and 11 of this output current mirror.

A voltage source 13 is provided for the voltage supply of the arrangement. Furthermore, a reference current bank 12 is provided, within which a current mirror circuit with an input transistor 14 and three output transistors 15, 16 and 17 are arranged. A constant current Io gained by means of a current source 18 is coupled to the collector of the input transistor 14 of this current mirror circuit. The emitter of the input transistor 14 is coupled to reference potential via a resistor 19.

The two transistors 15 and 16 of the current mirror, which have equal emitter areas and whose emitters are coupled to reference potential via resistors 20 and 21, supply a first reference current 2Io at their collectors. Together with the output current supplied by the resistor 4, this first reference current is coupled to the emitters of the first output transistor 10 and the second output transistor 11 of the output current mirror.

The current mirror circuit in the reference current bank 12 further supplies a second reference current Io by means of the third output transistor 17 whose emitter is coupled to reference potential via a resistor 22.

Since the output current mirror has two output transistors 10 and 11, the first reference current 2Io is chosen to be twice as large as the second reference current Io. Generally, the first reference current is the n-fold value of the second reference current in the case of n output transistors of the output current mirror.

To ensure that the voltage dUbe shown in the Figure and representing the base-emitter voltage between the input transistor 9 and the output transistors 10 and 11 of the output current mirror is minimal or tends towards zero, the collector current of the first output transistor 10 of the output current mirror is coupled to an input of a first current mirror circuit 23. The output current of this first current mirror circuit 23 is coupled to the collector of the input transistor 9 of the output current mirror. It is thereby ensured that the same current flows in the two output transistors 10 and 11, on the one hand, and in the input transistor 9 of the output current mirror, on the other hand. This in turn has the result that the voltage dUbe tends towards zero so that the temperature-dependent current gains of the transistors do not play a role anymore and the temperature drift of the transistors thus substantially does not play any role for gaining the control value.

The first current mirror circuit 23 is formed as a Wilson current mirror with a transistor 24 at its input, whose collector represents the input of the circuit arrangement and whose emitter is coupled to the power supply potential. The base of the transistor 24 is coupled to the base of a further transistor 25 and to the emitter of a transistor 26. The emitter of the transistor 25 is coupled to reference potential and its collector is coupled to the emitter of the transistor 26. The base of the transistor 26 receives the input signal. The collector of the transistor 26 supplies the output signal which is coupled to the collector of the input transistor 9 of the output current mirror.

Furthermore, a second current mirror circuit 27 and a third current mirror circuit 28 are provided.

The second current mirror circuit 27 and the third current mirror circuit 28 internally comprise transistors 29, 30 and 31, and 32, 33 and 34 and are arranged as Wilson current mirrors corresponding to the first current mirror.

The current flowing through the collector of the second output transistor 11 of the output current mirror is applied to the input of the second current mirror 27, thus to the collector of its transistor 29 and the base of its transistor 31. At the output, the collector of the transistor 31 of the second current mirror 27 supplies a current which is coupled to a first resistor 35. The other terminal of the resistor 35 is coupled to reference potential.

The second reference current Io supplied by the reference current bank 12 is coupled to the input of the third current mirror 28, i.e. to the collector of its transistor 32 and the base of its transistor 34. At the output, the third current mirror 28 or the collector of its transistor 34 supplies a current which is coupled to a second resistor 36, the other terminal of which is also coupled to reference potential.

The difference of the voltage dropping across the two resistors 35 and 36, denoted by dUr in the FIGURE, represents the control value.

The circuit arrangement further comprises compensation transistors 37, 38 and 39 which are used for compensating the base currents of the transistors 9, 10 and 11 of the output current mirror. Their number corresponds to the overall number of transistors of the output current mirror. In the embodiment shown in the FIGURE, the output current mirror has three transistors so that three output transistors 37, 38 and 39 are provided. Two thirds of the base currents are drained via the collectors of the transistors 37 and 38 to the power supply potential, their emitters being coupled to the bases of the transistors 9, 10 and 11. The bases of all output transistors 37, 38 and 39 are coupled to the collector of the input transistor 9 of the output current mirror.

To compensate the base current of the second output transistor 11 of the output current mirror, the collector of the third output transistor 39 is coupled to the collector of the second output transistor 11 of the output current mirror so that the base current of the second output transistor 11 of the output current mirror is compensated in the input signal which is applied to the second current mirror 27.

To ensure a safe start-up of the circuit arrangement when switching on the power supply voltage, a further transistor 40 is provided whose emitter is coupled to the bases of the transistors 14 to 17 of the current mirror of the reference current bank and whose input is coupled to the collector of the transistor 14 of the current mirror circuit in the reference current bank 12. The current flowing through the collector of the transistor 40 is coupled to the emitter of a transistor 41 whose collector is coupled to the power supply potential and whose base current is coupled to the input of the first current mirror 23. Thus, it is superimposed with the current through the first output transistor 10 of the output current mirror. However, in normal operation, this plays a subordinate role because this current is several values smaller than the current flowing through the transistor 10. However, it is achieved by this current that the circuit arrangement has a safe start-up, i.e. the first current 23 supplies a current after switching on the power supply voltage.

In the embodiment shown in the FIGURE, the output current mirror comprises two output transistors 10 and 11. Basically, a different number of output transistors may be provided. It is, however, essential that transistors of a first type, such as the transistor 10 in the embodiment shown in the FIGURE, are always coupled to the input of the first current mirror and that transistors of a second type, such as the output transistor 11 in the embodiment shown in the FIGURE, are coupled to the input of the second current mirror 24. In conformity with the number and areas of the output transistors of the two types, the first and the second reference current are to be chosen, and the values of the resistors 35 and 36 are to be adjusted in such a way that the currents flowing in the resistors 35 and 36 and being independent of the output current are equally large.

In the embodiment shown in the FIGURE, the transistors 10 and 11 have equal areas so that the currents Ix flowing through the collectors are equally large. The current Ix is Io± the output current flowing through the resistor 4. This is achieved, inter alia, by the feedback of the current Ix via the first current mirror 23 to the input transistor 9 of the output current mirror, as elucidated hereinbefore. Since the current Ix has only this dependence, there is also a current flowing which only has this dependence and is coupled to the first resistor 35 via the second current mirror 27. A current which is only dependent on the current Io flows through the second resistor 36. It is thereby achieved that the difference between the voltages dropping across the resistors 35 and 36 is only dependent on the output current. This is exactly the object because temperature dependencies have been eliminated in this way.

Dependent on this difference voltage dUr, a control signal for the transistors 5, 6 and 7, 8 of the load 1 may be gained, for example, by means of operational amplifiers (not shown), so that the load current through the load 2 is controllable by means of these transistors.

What is claimed is:

1. An arrangement for coupling out an output current from a load current by a load (2), particularly a deflection coil of a cathode ray tube by means of an output resistor (4), which arrangement comprises an output current mirror (9, 10, 11), in which a control value in the form of the difference between two voltages dropping across two resistors (35, 36) for controlling the load current is generated and in which a reference current bank (12) is provided with a current mirror circuit whose input receives a constant current for generating constant currents, characterized in that the output current is coupled to the emitter of at least a first output transistor (10) and at least a second output transistor (11) of the output current mirror, in that the reference current bank (12) supplies a first reference current which, together with the output current, is coupled to the emitter of the first output transistor (10) and the second output transistor (11) of the output current mirror, in that the current through the collector of the first output transistor (10) of the output current mirror is coupled to the input of a first current mirror (23), in that the output current of the first current mirror (23) is coupled to the collector of at least one input transistor (9) of the output current mirror, in that a second current mirror (27) is provided to whose input the current through the collector of the second output transistor (11) of the output current mirror is coupled and whose output current is coupled to a first resistor (35), in that a third current mirror (28) is provided to whose input a second reference current from the reference current bank (12) is coupled and whose output current is coupled to a second resistor (36), in that the input transistor (9) of the output current mirror has the same emitter area as that of the first output transistor (10), and in that the difference between the voltages dropping across the first resistor (35) and the second resistor (36) represents the control value.

2. An arrangement as claimed in claim 1, characterized in that the emitters of the first output transistor (10) and the second output transistor (11) of the output current mirror have the same value so that the currents flowing through these two transistors (10, 11) have the same value.

3. An arrangement as claimed in claim 1, characterized in that the first output transistor (10) and the second output transistor (11) of the output current mirror have the same emitter areas, and in that the first reference current is the n-fold value of the second reference current, in which n is the number of output transistors (10, 11) of the output current mirror.

4. An arrangement as claimed in claim 1, characterized in that all transistors of the output current mirror have the same emitter area, in that n+k compensation transistors (37, 38, 39) for compensating the base currents of the transistors (9, 10, 11) of the output current mirror are arranged between the collector and the base of the input transistor (9) of the output current mirror, in which n is the number of output transistors (10, 11) of the output current mirror and k is the number of its input transistors, in that the bases of all n+k compensation transistors (37, 38,39) are coupled to the collector of the input transistor (9) of the output current mirror, in that n+k−m base currents of the transistors (9, 10, 11) of the output current mirror are drained to a power supply potential by means of n+k−m of these compensation transistors (37, 38) via their collectors, in which m is the number of the second output transistors (11) of the output current mirror, and in that m base currents of the transistors (9, 10, 11) of the output current mirror are superimposed on the input current of the second current mirror (27) by means of m of these compensation transistors (39), whose collectors are coupled to the input of the second current mirror (27).

5. An arrangement as claimed in claim 1, characterized in that a transistor (40) for coupling out the base currents of the transistors (14, 15, 16, 17) of the current mirror of the reference current bank (12) is arranged between the collector and the base of the input transistor (14) of the current mirror of the reference current bank, the base of said transistor (40) being connected to the collector of the input transistor (14) of the current mirror circuit of the reference current bank (12) and its emitter being connected to the base of this transistor (14), which transistor (40) superimposes these base currents via a further transistor (41) on the input current of the first current mirror (23).

6. An arrangement as claimed in claim 1, characterized in that the output current mirror comprises an input transistor (9) arranged as a transistor diode.

7. An arrangement as claimed in claim 1, characterized in that the first current mirror (23), the second current mirror (27) and the third current mirror (28) are formed as Wilson current mirrors.

8. An arrangement as claimed in claim 1, characterized in that the load current is a current flowing through a vertical deflection coil of a display tube.

* * * * *